US007506945B2

(12) United States Patent
Noguchi

(10) Patent No.: US 7,506,945 B2
(45) Date of Patent: Mar. 24, 2009

(54) INKJET PRINTER AND INKJET PRINTING METHOD

(75) Inventor: Eri Noguchi, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 72 days.

(21) Appl. No.: 11/741,873

(22) Filed: Apr. 30, 2007

(65) Prior Publication Data

US 2007/0285450 A1 Dec. 13, 2007

(30) Foreign Application Priority Data

May 9, 2006 (JP) ..... 2006-130790

(51) Int. Cl.
*B41J 29/38* (2006.01)

(52) U.S. Cl. ..... 347/12; 347/15; 347/43

(58) Field of Classification Search ..... 347/15, 347/43, 41, 12, 40
See application file for complete search history.

(56) References Cited

U.S. PATENT DOCUMENTS 6,206,502 B1 * 3/2001 Kato et al. ..... 347/41
6,779,873 B2 8/2004 Maeda et al.
6,874,864 B1 4/2005 Maeda et al.
2002/0105557 A1 * 8/2002 Teshigawara et al. ..... 347/15
2003/0067508 A1 4/2003 Mizutani et al.
2005/0168531 A1 8/2005 Mizutani et al.
2007/0216724 A1 9/2007 Shibata et al.
2007/0236745 A1 10/2007 Noguchi et al.

FOREIGN PATENT DOCUMENTS

JP 2002-96455 A 4/2002
JP 2002-292910 A 10/2002
JP 2003-145775 A 5/2003

* cited by examiner

*Primary Examiner*—Lamson D Nguyen
(74) *Attorney, Agent, or Firm*—Fitzpatrick, Cella, Harper & Scinto

(57) ABSTRACT

An image having high quality is output, in which density unevenness due to a deflection in an ejecting direction is reduced, in an inkjet printer for forming an image by ejecting small droplets at a high frequency and high density. Thereby, in a mask pattern employed for multi-pass printing, a print permission rate of an ejection port positioned at the end of a ejection port array is set higher than those of ejection ports positioned at the other parts of the ejection port array. Thus, even if extremely small droplets are ejected at a high frequency and high-density, the generated density unevenness is reduced, and an image excellent in uniformity and having high definition can be output at a high speed.

2 Claims, 20 Drawing Sheets

INKJET PRINTER AND INKJET PRINTING METHOD

BACKGROUND OF THE INVENTION

1. Field of the Invention

The present invention relates to an inkjet printer and inkjet printing method, in particular, it relates to an inkjet printer and inkjet printing method for printing small droplet of ink at a high density and high frequency.

2. Description of the Related Art

Small droplet, high density nozzles and high driving frequencies have been promoted in inkjet printers. Under such circumstances, there has recently arisen a new problem called "end-deviation."

FIG. 1 is a schematic view showing an "end-deviation." In FIG. 1, the reference numeral 11 denotes a printing head, and the printing head 11 vertically moves while ejecting ink droplets 13 from a plurality of ejection ports arranged at an ejection port surface 14 at a high density. The ejected ink droplets 13 impact a print medium 12 to form a dot. In a high ejecting frequency of the printing head, air with viscosity surrounding the ink droplets 13 move with a movement of the ink droplet 13 flying toward the print medium 12 at a high density. As a result, a pressure in the vicinity of the ejection port surface 14 becomes smaller than that of the periphery of the printing head 11, and air surrounding the above air flows into the decompressed area in a direction shown by the arrows. The airflow especially deflects the ink droplets 13 ejected from the ejection ports positioned at both ends of an ejection port array toward the ejection ports positioned at the center thereof, and makes the ink droplets 13 impact a position deviated from a target position on the print medium 12.

FIG. 2 is a graph showing test results that the inventors performed to check the degree of the above "end-deviation." In this case, the distance (distance to the paper) from the ejection port surface 14 to the print medium 12 was 1.3 mm, 128 ejection ports were arranged at intervals of approximately 21.2 μm, the ejection volume from each ejection port was 2.8 pl, and the ejecting frequency from each ejection port was 25 KHz. In FIG. 2, the horizontal axis indicates each arrangement position of the aligned ejection ports. In addition, the vertical axis indicates a deviation amount of a position, where the ink droplets ejected from each ejection port actually impact, from the target position. Here, in the state shown in FIG. 1, the case of impacting from the right side of the target position is shown as "+," and the case of impacting from the left side is shown as "−." That is, FIG. 2 reveals that the ink droplets ejected from the ejection ports at the outermost both ends are deviated to innermost sides and printed (approximately 10 μm), the deviation amount is slowly reduced as the position of the ejection port becomes close to the center, and that the print position deviation amount of the ink droplets ejected from the center ejection port becomes smallest.

FIG. 3 is a view showing a print state in the case of actually printing a uniform image with the printing head which generates such a print state. The printing head 11 mounted on a carriage moves from left to right in FIG. 3 at a predetermined speed while ejecting ink from each ejection port 31 at a fixed ejecting frequency. An image 32 formed by a first print scanning and an image 33 formed in a second print scanning are shown in FIG. 3. The ink droplets ejected from the ejection ports at the end of the printing head are deflected toward the center of the printing head to impact the print medium, and thus an area to be naturally printed by the ink droplets ejected from the ejection ports at the end appears as a blank area 34.

Such a blank area 34 is generated at each connecting part between the print scannings to lower the quality of a uniform image area.

The "end-deviation" is generally easily checked as the ejection volume becomes small, the ejecting frequency is high and the arrangement density of the ejection ports is high, in particular, it becomes apparent when the ejection volume is not more than 10 pl.

FIG. 4 is a graph showing a relationship between the ejection volume and an end-deviation amount examined by the inventors. Here, a printing head having the same conditions as the printing head shown in FIG. 1 is used, the horizontal axis shows variation of the ejection volume from approximately 5 pl to 16 pl, and the vertical axis shows the print position deviation amount of the ink droplets ejected from the ejection ports positioned at the outermost end. FIG. 4 reveals that the print position deviation amount becomes large as the ejection volume becomes small. Therefore, it is considered that, as the ink droplets become small, the rate of the surface area to weight of the ink droplets is increased and the ink droplets easily receive influence from the airflow.

Regarding the "end-deviation" as described above, various countermeasures have been proposed. For example, a constitution is disclosed that an amount of the ink droplets ejected from the ejection ports positioned at the further end is set large in advance in arranging a plurality of ejection ports in the printing head. Thus, an inertia weight of the ink droplets from the end can be increased, and the airflow in the vicinity of the end hardly has influence on the ink droplets. However, making the ink droplets lager prevents an image having high definition and high gradation from being formed. In the inkjet printer having the advantage of performing printing with small droplets of ink at a high definition, increasing the ejection volume although partially is not suitable as a solving method of the end-deviation.

On the other hand, Japanese Published Unexamined Patent Application No. 2003-145775 discloses a printing head in which ejection ports positioned at the end are arranged at pitches larger than that of the center. For example, ejection ports positioned in the vicinity of the end are arranged at larger intervals than 21.2 μm in anticipation of the print position deviation, so that dots are printed on the print medium at pitches of 21.2 μm even if the end-deviation arises. However, even when a low duty image, in which the end deviation can hardly arise, is formed with the printing head having such a constitution, a print position of the ink droplets ejected from the ejection ports positioned at the end is deviated further outward. Accordingly, in this case, an area arises in which the connecting part between the print scans excessively overlap with each other, and there is a risk that black streaks become conspicuous.

The "end-deviation" arises under conditions with a small ejection volume, a high ejecting frequency, and a high print density. Accordingly, if any one of the conditions is removed, the "end-deviation" can be reduced. However, these conditions are all essential for printing an image having a high resolution and high quality at a high speed. Accordingly, a reducing method of the "end-deviation" without removing the conditions is demanded.

Japanese Patent Laid-Open Nos. 2002-096455 and 2002-292910 disclose a reducing method of the "end-deviation" adverse effects by providing a mask pattern to be used in performing a multi-pass printing method with features.

FIG. 5 is an explanatory schematic view of the multi-pass printing method. Here, a two-pass type multi-pass printing method is shown which completes an image in an arbitrary area by two print scannings. In FIG. 5, the reference numeral

1200 denotes a printing head having ejection port arrays for four colors. The printing head 1200 ejects ink droplets while moving in a main scanning direction in FIG. 5 to print dots onto the print medium.

However, in the multi-pass printing method, printing is not performed for all printable pixels by only one print scanning. For example, in the two-pass type multi-pass printing, printing is performed for approximately half of all printable pixels via the ejection ports positioned at the lower half part of the printing head 1200 in a first print scanning. When the first print scanning is performed, the print medium is conveyed by a length corresponding to half of a print width of the printing head 1200 in a sub-scanning direction in FIG. 5.

In the following second print scanning, printing is performed for the remaining pixels via the ejection ports positioned at the upper half part of the printing head 1200 in the image area where the printing has already been performed for approximately half of all pixels by the first print scanning. In addition, in the second print scanning, the lower half part of the printing head 1200 performs printing for the pixels of approximately half of the blank area adjacent to the image area. When the second print scanning ends, the print medium is further conveyed by the length corresponding to half of the print width of the printing head 1200 in the sub-scanning direction in FIG. 5.

In the two-pass type multi-pass printing method, the image is formed in stages by alternately repeating the above print main scanning to half of all pixels and the sub-scanning of the length corresponding to half of the print width. According to the multi-pass printing method, the image is formed in the identical image area on the print medium by a plurality of print scannings via the ejection port groups different from each other in the printing head. Accordingly, even if there are variations in the ejecting direction and the ejection volume of the ejection ports, and even if there are some variations in conveying amount of the print medium, it is possible to make adverse effects due to the variations inconspicuous. Furthermore, although the two-pass type multi-pass printing method for completing an image by the two print main scannings is described above with reference to FIG. 5, the number of multi-passes is not limited thereto. As the number of multi-passes is increased, a formed image becomes excellent in uniformity.

When the above-described multi-pass printing method is employed, a mask pattern, in which permission or non-permission of printing is determined, is frequently used in order to determine pixels for which the printing is to be performed by each print main scanning. Various image quality items other than uniformity can be improved by providing such a mask pattern with various features.

FIG. 6 is disclosed in Japanese Patent Laid-Open No. 2002-096455, and is a view showing mask patterns which are improved to avoid the end-deviation. Here, a printing head having 768 ejection ports is employed, and mask patterns used for performing four-pass type multi-pass printing is shown. The size of the mask pattern is 768 are as corresponding to the number of ejection ports in a vertical direction, and 256 are as in a horizontal direction. An area shown by black is a print permission pixel, and an area shown by white is a print non-permission pixel. The print permission or print non-permission of each pixel is determined so that the four mask patterns corresponding to four ejection port groups respectively are complementary to each other.

As shown in FIG. 6, a bias is provided between the numbers of print permission pixels in accordance with positions of the ejection ports. A print permission rate of the ejection port at the end is lowered compared with that of the center so that adverse effects due to impact position deviations of the ink droplets ejected from the ejection ports at the end can be made inconspicuous.

Japanese Patent Laid-Open No. 2002-96455 discloses that a bias is provided between the numbers of print permission pixels in accordance with positions of ejection ports. Furthermore, Japanese Patent Laid-Open No. 2002-96455 discloses that it is effective to lower the print permission rate of the ejection port positioned at the end compared with that of the ejection port positioned at the center as shown in FIG. 6 to reduce the "end-deviation."

However, currently when reduction in the ejection volume is being further promoted, as the inventors carried out a diligent examination, they confirmed that only droplet ejected from the ejection port at the end are not always deflected toward the center.

FIG. 7 is a schematic view showing a deflection state in an ejecting direction different from the end-deviation. In FIG. 7, the reference numeral 81 denotes a printing head, and 256 ejection ports for ejecting ink droplets of 0.6 pl are arranged at pitches of 1200 dpi (intervals of approximately 21 μm). In FIG. 7, 16 every 16 ejection ports arranged per one line are shown as 1*n*, 17*n* to 241*n*, for convenience. The inventors printed an image 82 of 50% duty at a print density of 1200 dpi while making a carriage, on which such a printing head 81 is mounted, scan in relation to the print medium at 251 inch/sec. In this case, 100% duty shows a state where the dots are printed on all pixels arranged at 1200 dpi. The distance between the ejection port surface and the print medium in printing was 1.0 mm.

In FIG. 7, the reference numeral 83 denotes a dot formed by the ink droplets ejected from each of the ejection ports 1*n*, 17*n* to 241*n* on the print medium. According to the example, in an array of a series of ejection ports, although deflections of the ink ejected from the ejection ports positioned at the center and both ends are not found, ink ejected from the ejection ports positioned in the vicinity of the middle between the center and the ends is deflected in a ejection port arrangement direction (sub-scanning direction). The inventors confirmed that the deviation amount of the most deflected ink in the sub-scanning direction was approximately 15 μm.

FIG. 8 is a graph showing the relationship between the position of the ejection port and the print position deviation obtained in the mentioned examination. In FIG. 8, the horizontal axis shows an ejection port number representing the position of the ejection port, and the vertical axis shows a print position deviation amount of the dot printed with the ink droplets ejected from each ejection port in the sub-scanning direction. As shown in FIG. 8, in the example, the position of the dot printed via the ejection port positioned at the middle between the outermost ends and the center is most deviated in the array of the series of ejection ports. The print position deviation amount and the deviation direction are gradually fluctuated in accordance with the arrangement position of the ejection ports, and each is almost symmetrical in relation to the center of the ejection port array.

FIG. 9 is a view showing a print state in the case where an image is actually printed by one-pass with use of the printing head in such a print state. A printing head 101 moves from left to right in FIG. 9 at a predetermined speed with it mounted on the carriage, and ink is ejected from each ejection port 31 at a ejecting frequency corresponding to the moving speed. In FIG. 9, a white streak shown in FIG. 3 is not generated in an end area of an image formed by each print scanning. However, since an dot impact position via the ejection port positioned at the slightly inside from the end is deviated toward the center, a part having a high density 102 and a part having a low density 103 are alternately arranged.

Even if an image is formed by using the mask patterns (FIG. 6) disclosed in Japanese Patent Laid-Open No. 2002-096455 for the printing head in such a print state, the density unevenness is not reduced. If the mask patterns shown in FIG. 6 are used which extremely reduce the print permission rate of the end area having few deviations and raises the print permission rate of the area having many deviations, adverse effects due to the density unevenness becomes more conspicuous.

SUMMARY OF THE INVENTION

In order to solve the above problems, the present invention has been made. An object of the present invention is that an image having a high quality is output, in which density unevenness due to a deflection in an ejecting direction is reduced, in an inkjet printer for forming an image by ejecting small droplets of ink at a high frequency and high density.

The first aspect of the present invention is an inkjet printer for printing an image on a print medium by ejecting ink from a printing head having an ejection port array based on a print permission rate determined in advance for the ejection port array while moving the printing head with respect to the print medium, wherein respective print permission rates of respective ejection ports positioned at both ends of the ejection port array are higher than that of a ejection port positioned at the center of the ejection port array.

The second aspect of the present invention is an inkjet printer for printing an image on a print medium by ejecting ink from a printing head having first ejection port array and second ejection port array based on a print permission rates determined in advance for the respective first and second ejection port arrays while moving the printing head with respect to the print medium, wherein respective print permission rates of respective ejection ports positioned at both ends of the first ejection port array are higher than that of a ejection port positioned at the center of the first ejection port array, and respective print permission rates of respective ejection ports positioned at both ends of the second ejection port array are lower than that of a ejection port positioned at the center of the second ejection port array.

The third aspect of the present invention is an inkjet printer for printing an image on a print medium by moving a printing head comprising a plurality of ejection port arrays each having an arrangement of ejection ports for ejecting ink with respect to the print medium comprising: means for completing an image to be printed in an identical area in the print medium by printing an image in accordance with a mask pattern in each of a plurality of movements of the printing head, the mask pattern having a print permission rate determined for every ejection port, wherein in the mask pattern corresponding to at least one of the ejection port arrays among the plurality of ejection port arrays, respective print permission rates of respective ejection ports positioned at both ends of the ejection port array are set higher than those of respective ejection ports positioned at the other parts of the ejection port array.

The forth aspect of the present invention is an inkjet printing method for printing an image on a print medium by ejecting ink from a printing head having an ejection port array composed of an arrangement of ejection ports for ejecting the ink based on a print permission rate determined in advance for the ejection port array while moving the printing head with respect to the print medium in a direction crossing the arrangement direction of the ejection ports, wherein respective print permission rates of respective ejection ports positioned at both ends of the ejection port array are higher than that of a ejection port positioned at the center of the ejection port array.

The fifth aspect of the present invention is an inkjet printing method for printing an image on a print medium by ejecting ink from a printing head having first ejection port array and second ejection port array based on a print permission rates determined in advance for the respective first and second ejection port arrays while moving the printing head with respect to the print medium, wherein respective print permission rates of respective ejection ports positioned at both ends of the first ejection port array are higher than that of a ejection port positioned at the center of the first ejection port array, and respective print permission rates of respective ejection ports positioned at both ends of the second ejection port array are lower than that of a ejection port positioned at the center of the second ejection port array.

The sixth aspect of the present invention is an inkjet printing method for printing an image on a print medium by moving a printing head having a plurality of ejection port arrays each having an arrangement of ejection ports for ejecting ink with respect to the print medium comprising the step of: completing an image to be printed in an identical area in the print medium by printing an image in accordance with a mask pattern in each of a plurality of movements of the printing head, the mask pattern having a print permission rate determined for every ejection port, wherein in the mask pattern corresponding to at least one of the ejection port array among the plurality of ejection port arrays, respective print permission rates of respective ejection ports positioned at both ends of the ejection port array are set higher than those of respective ejection ports positioned at the other parts of the ejection port array.

Further features of the present invention will become apparent from the following description of exemplary embodiments (with reference to the attached drawings).

DESCRIPTION OF THE EMBODIMENTS

An embodiment of the present invention will be described below citing a serial type inkjet printer having printing heads provided with a plurality of ejection port arrays as an example.

Figure 10:
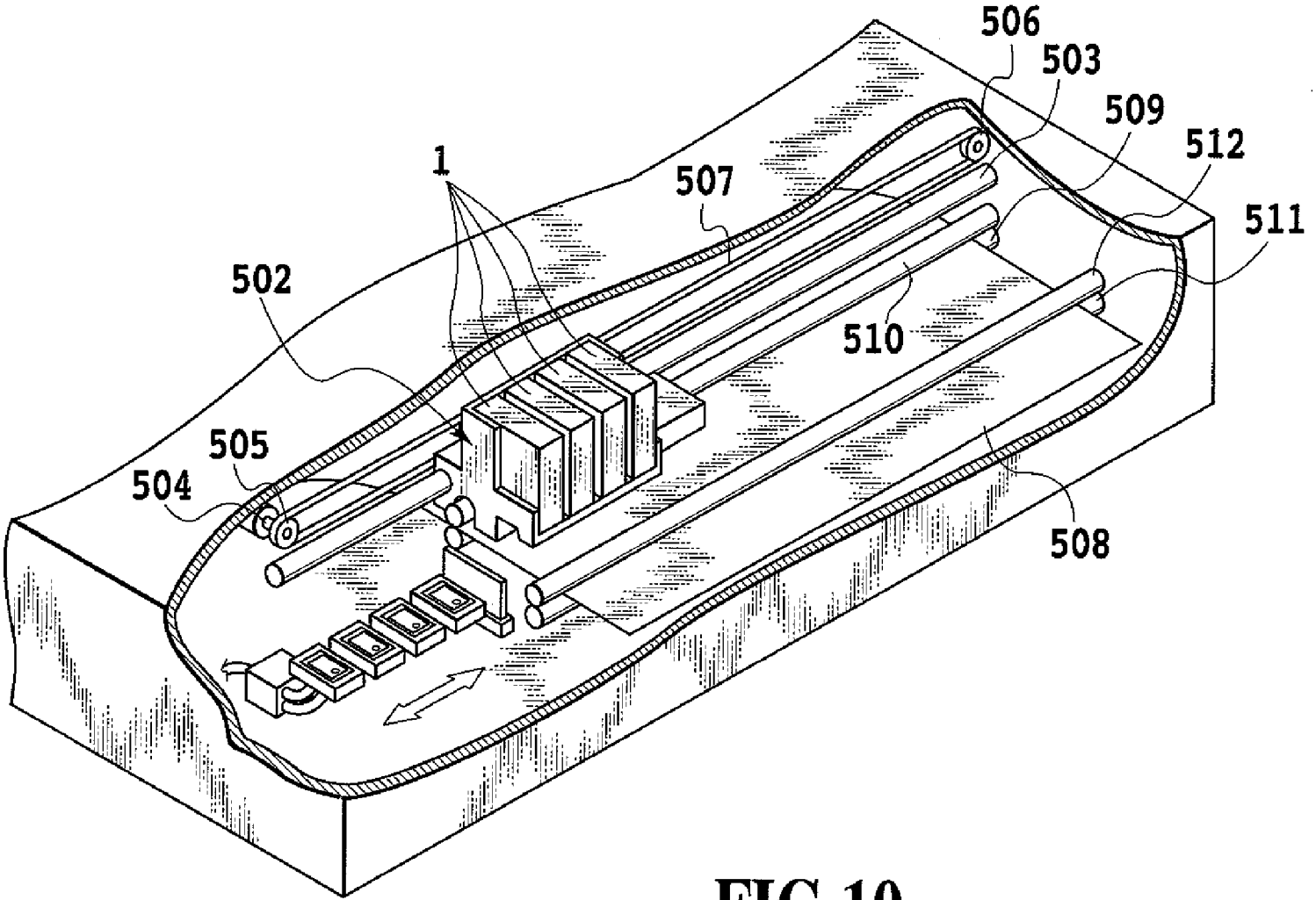
FIG. 10 is a schematic perspective view showing a main part of an inkjet printer according to an embodiment of the present invention.

FIG. 10 is a schematic perspective view showing a main part of an inkjet printer according to the embodiment of the present invention. In FIG. 10, the reference numeral 502 denotes a carriage, and printing heads 1 and ink tanks for supplying ink of four colors thereto are changeably mounted on the carriage 502.

The ink of four colors are printable via the printing head 1, and cyan ink, magenta ink, yellow ink and black ink are respectively supplied from the ink tanks. The printing head 1 is positioned and changeably mounted on the carriage 502, a connector holder (electrical connecting part), in which a driving signal, etc., is transmitted to the printing head 1 via a connector, is provided on the carriage 502.

The carriage 502 moves along a guide shaft 503 provided in an apparatus main body while being guided and supported in a main scanning direction. Driving force of a main scanning motor 504 is transmitted to a motor pulley 505, a following pulley 506 and a timing belt 507, and thus the carriage 502 moves, and a position and a movement amount thereof are controlled.

A print medium 508 such as a sheet of paper or plastic thin plate is conveyed so as to pass through a position (print part) opposite a ejection port surface of the printing head 1 by rotation of two sets of conveying rollers (509 and 510, and 511 and 512). Moreover, the back side of the print medium 508 is supported by a platen (not shown) so that the print medium 508 can form into a flat printing surface in the print part. The ejection port surface of the printing head 1 mounted on the carriage 502 is projected downward from the carriage 502 and held between the two sets of conveying rollers (509 and 510, and 511 and 512) so as to be kept parallel with the print medium 508.

Figure 11:
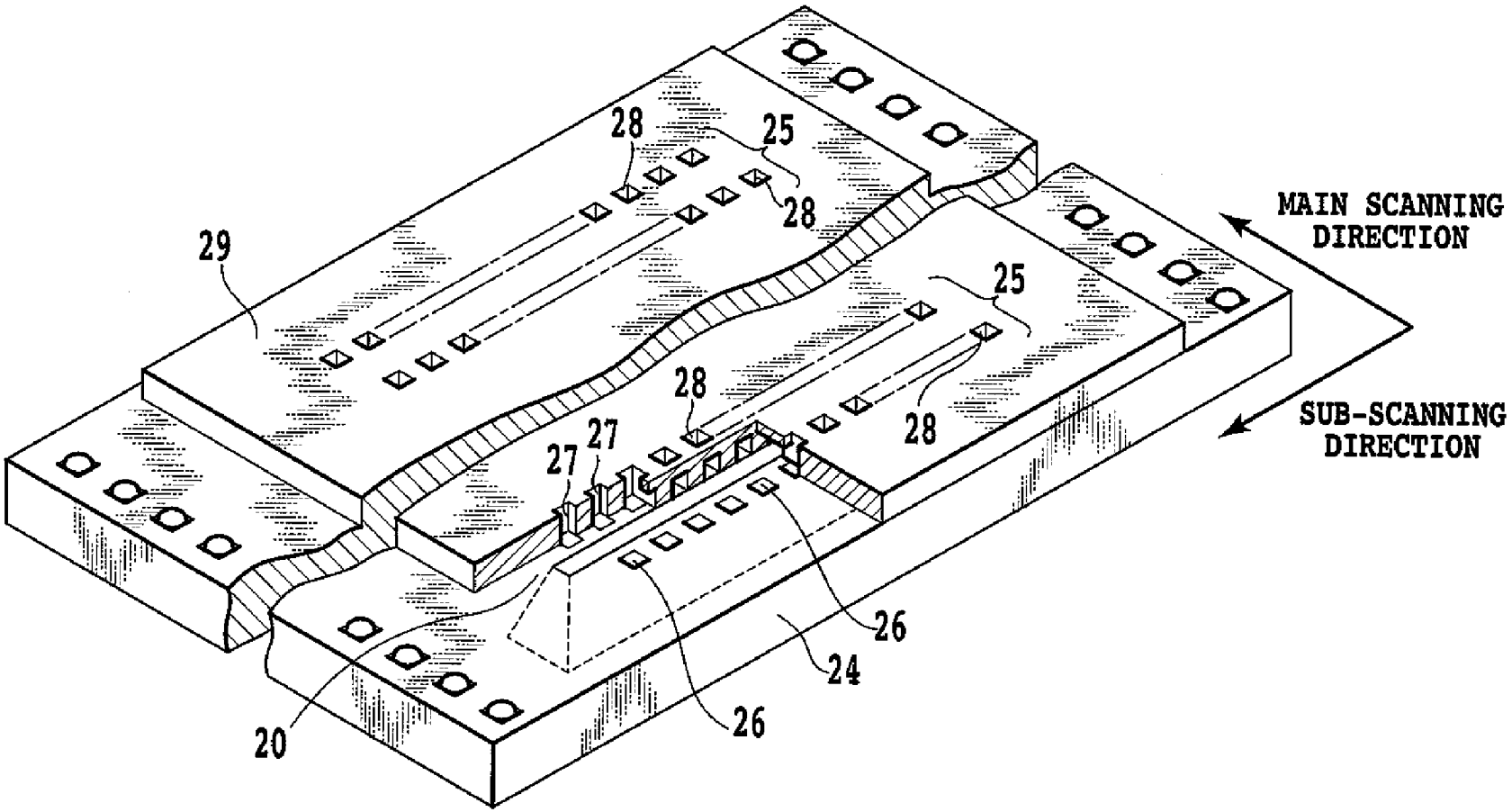
FIG. 11 is a cross sectional view of an ejection portion of a printing head.

FIG. 11 is a cross sectional view of an ejection portion of the printing head 1. In FIG. 11, the reference numeral 24 denotes a substrate composed of a silicon wafer. The substrate 24 is a part of an ink flow path constituting member, and serves as an electrical thermal converter (heater), ink flow-pass and supporting body of a material layer forming electrical thermal converters (heaters), ink flow paths and ejection ports. In the embodiment, the substrate 24 may be composed of glass, ceramics, plastic, metal, etc., other than silicon.

Electric thermal converters (heater) 26, which are thermal energy generating means, are arranged on a substrate 24 at pitches of 600 dpi in a sub-scanning direction, on both sides in a longitudinal direction of the ink supplying port 20. Furthermore, the two heater arrays are arranged so as to deviate from each other by a half pitch in the sub-scanning direction.

A coated resin layer 29 for introducing the ink into each heater is adhered to the substrate 24. Flow paths 27 and the ink supplying port 20 are formed in the coated resin layer 29, the flow paths 27 each being formed at the position corresponding to the heater, and the ink supplying port 20 being capable of evenly supplying the ink to each flow path 27. A tip of each flow path 27 forms into an ejection port 28 for ejecting ink droplets cased by a film boiling effect by the heater 26.

In the above constitution, a voltage is applied to each heater at a predetermined timing while the printing head is moved in a main scanning direction, and thus the ink droplets supplied from the same ink supplying port 20 can be printed at a resolution of 1200 dpi in the sub-scanning direction.

One kind of ink is supplied to one ink supplying port 20. A plurality of ink supplying ports 20 are juxtaposed on the substrate 24, and various kinds of ink can be respectively ejected from the ink supplying ports 20.

Figure 12:
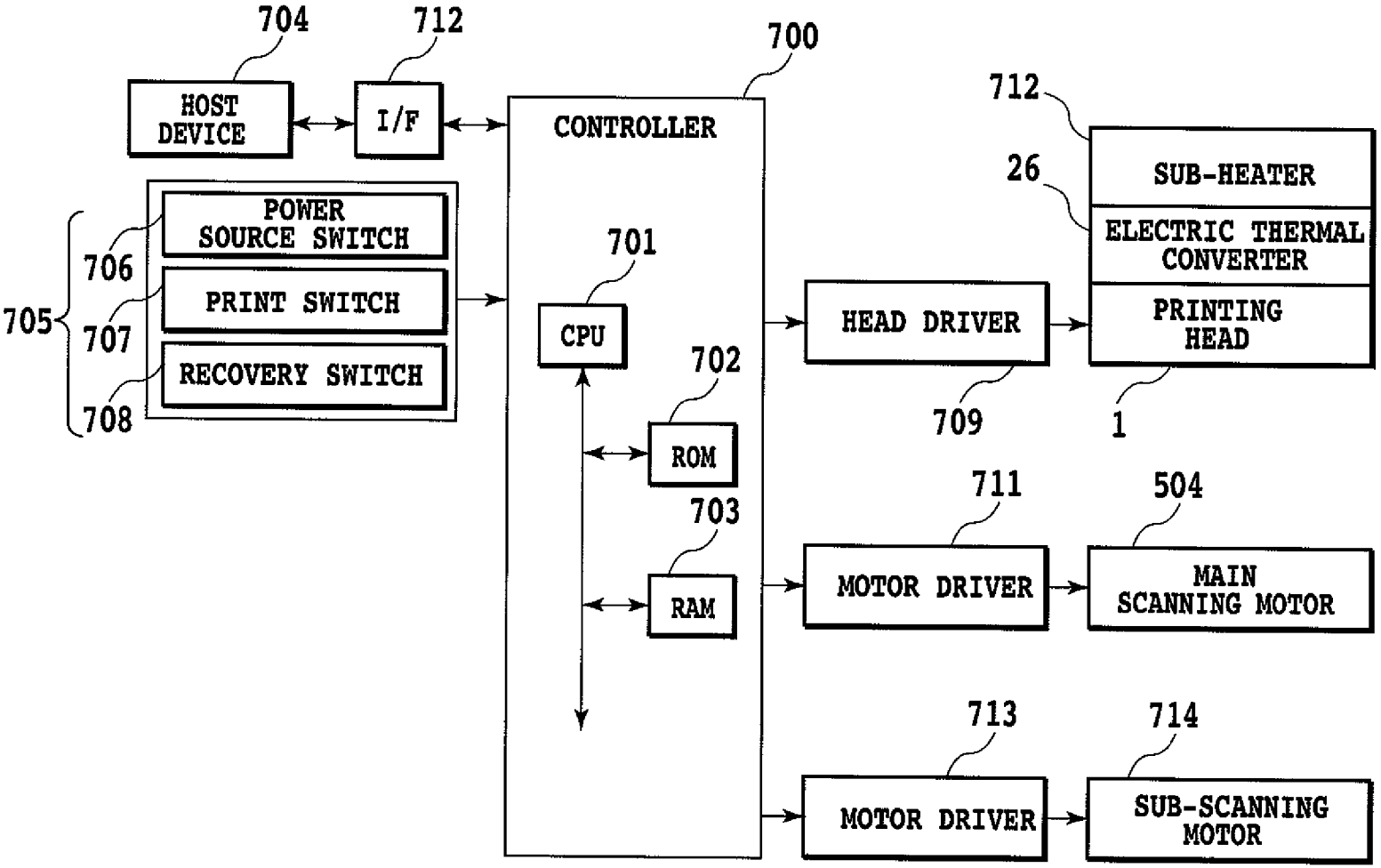
FIG. 12 is a block diagram illustrating a control constitution of the inkjet printer according to the embodiment of the present invention.

FIG. 12 is a block diagram illustrating a control constitution of the inkjet printer according to the embodiment. In FIG. 12, a controller 700 is a main controller, and includes: a CPU 701 in the form of, for example, a micro-computer; a ROM 702 in which a program, a desired table and other fixed data are stored; and a RAM 703 in which an area for development of image data, an area for working, etc., are provided. A mask pattern to be used in the embodiment is stored in the ROM 702. The CPU 701 performs logical AND operation between the image data supplied from a host device 704 and a mask pattern read from the ROM 702, generating print data for a plurality of print scanning. Then, the CPU 701 supplies this print data for each print scanning to a head driver 709.

The host device 704 connected to the exterior of the printer is a supplying source of the image data. However, the device 704 may be a computer for preparing and processing data such as an image to be printed, a reading part for reading the image, etc. Image data, other commands, status signals, etc., are transmitted/received to/from the controller 700 via an interface (I/F) 712.

An operating part 705 is a switch group for receiving an instruction input from an operator, and includes: a power source switch 706; a print switch 707 for instructing the controller to start printing operation; and a recovery switch 708 for instructing the controller to start maintenance processing for the printing head.

A head driver 709 is a driver for driving the electric thermal converters 26 of the printing head 1 in accordance with print data, etc. The head driver 709 includes: a shift register for making the print data align in accordance with the positions of the electric thermal converters 26; a latch circuit for latching at a proper timing; a logic circuit element for operating the electric thermal converters 26 in synchronization with a driving timing signal; a timing setting part for suitably setting a driving timing (ejecting timing) for dot formation positioning; etc.

A sub-heater 712 is provided in the printing head 1. The sub-heater 712 performs a temperature adjustment for stabilizing ink ejecting features. Although the sub-heater 712 may be formed on the substrate 24 of the printing head together with the electric thermal converter 26, this may be attached to a main body of the printing head 1.

A motor driver 711 is a driver for driving the main scanning motor 504, and a motor driver 713 is a driver for driving a sub-scanning motor 714 for generating force for rotating the conveying rollers.

Figure 13:
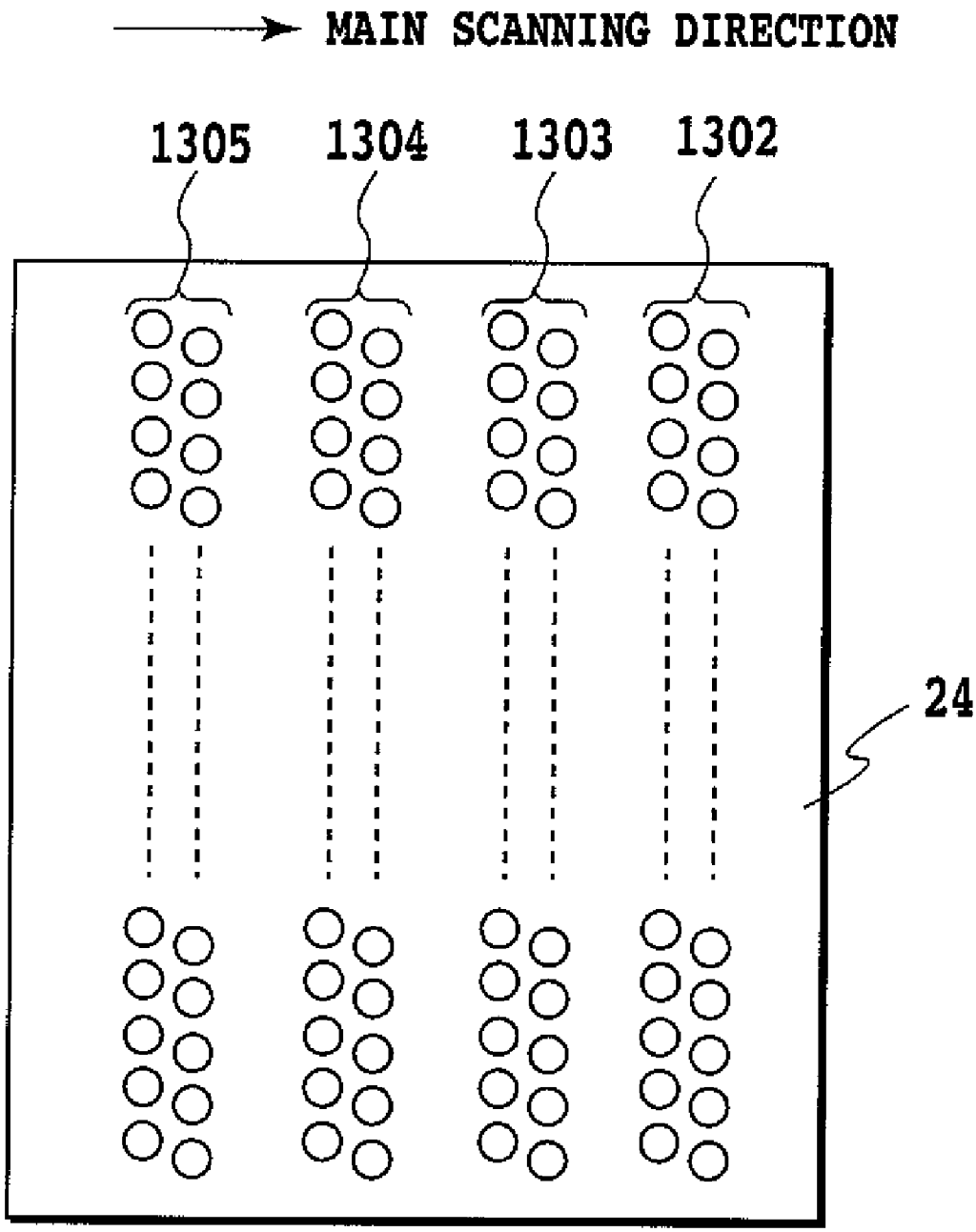
FIG. 13 is a view showing the printing head, which is observed from an ejection port surface side, according to a first embodiment of the present invention.

FIG. 13 is a view of the printing head 1 of the embodiment, which is observed from an ejection port surface side. Four ejection port arrays 1302 to 1305 are arranged on the substrate 24. Cyan ink is ejected from the ejection port array 1302, magenta ink is ejected from the ejection port array 1303, yellow ink is ejected from the ejection port array 1304, and black ink is ejected from the ejection port array 1305. Ink droplets of 0.6 pl are ejected from each ejection port. The ejection port array of each color is a pair of arrays with each having 128 ejection ports, that is, 256 in total, at pitches of 600 dpi, and which are arranged so as to deviate from each other by a half pitch.

Figure 14:
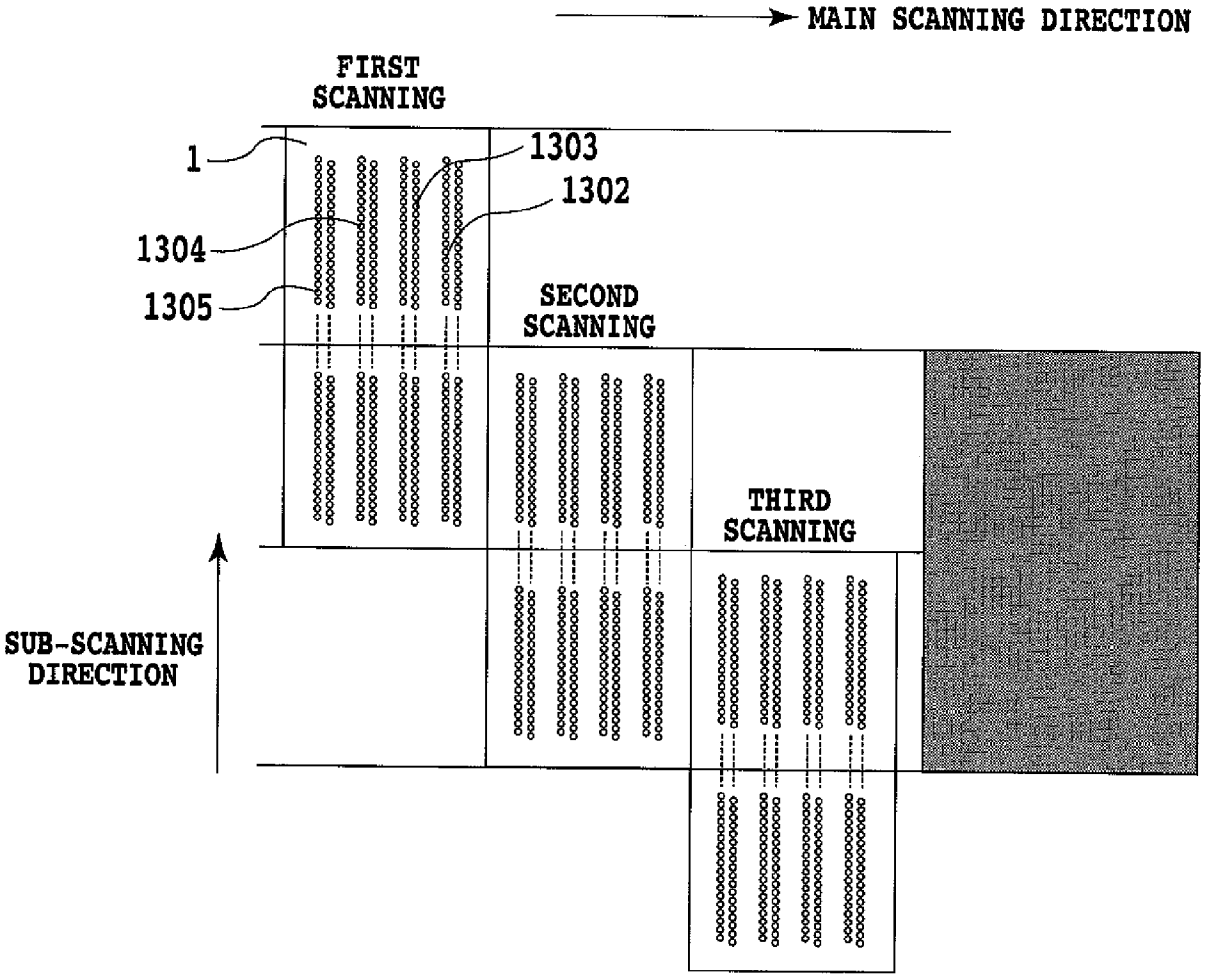
FIG. 14 is a view showing a print state in performing a two-pass type multi-pass printing.

FIG. 14 is a view showing a print state in performing a two-pass type multi-pass printing with use of the printing head 1. In FIG. 14, the printing head 1 performs ejecting ink while reciprocating in the main scanning direction so that the dots are printed on the print medium.

In a first print scanning, printing is performed for pixels of approximately 50% in forward direction via the 128 ejection ports of each color positioned at the lower half part of the printing head 1. When the first print scanning ends the print medium is conveyed by a length corresponding to half of a print width of the printing head 1 in the sub-scanning direction in FIG. 14.

Figure 1:
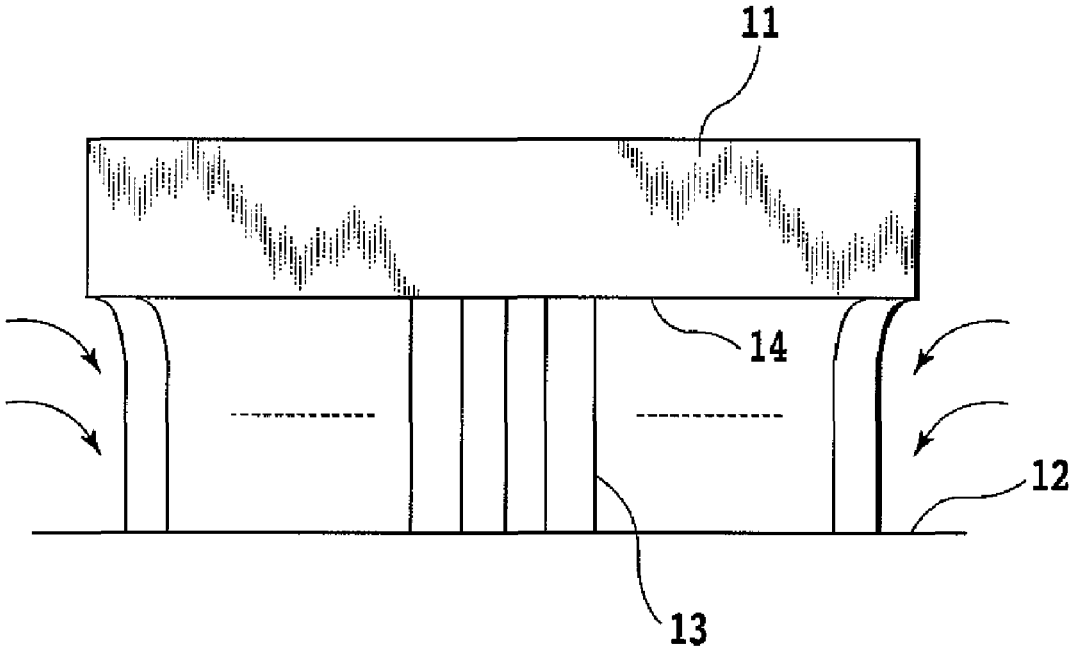
FIG. 1 is a schematic view showing an "end-deviation"
Figure 2:
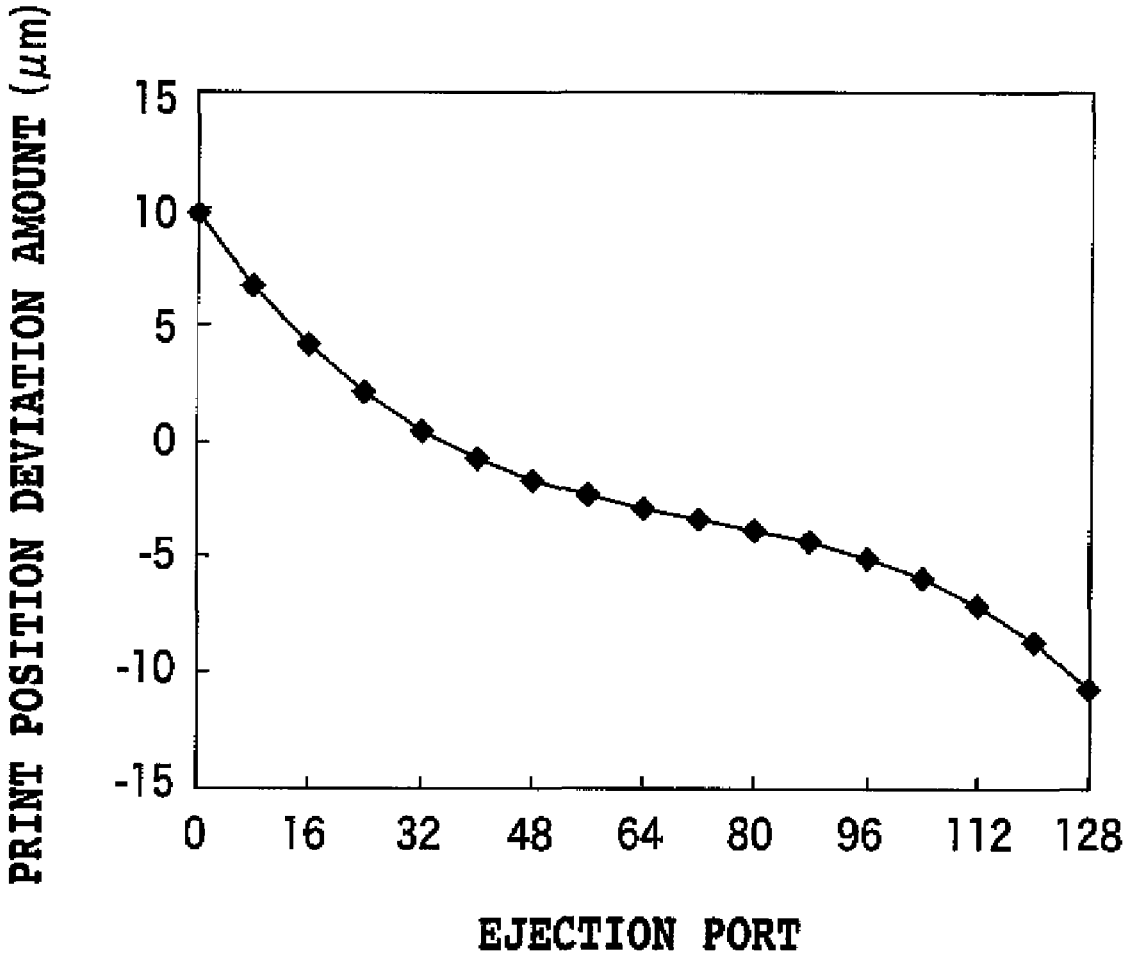
FIG. 2 is a graph showing test results that the inventors performed to check the degree of the "end-deviation"
Figure 3:
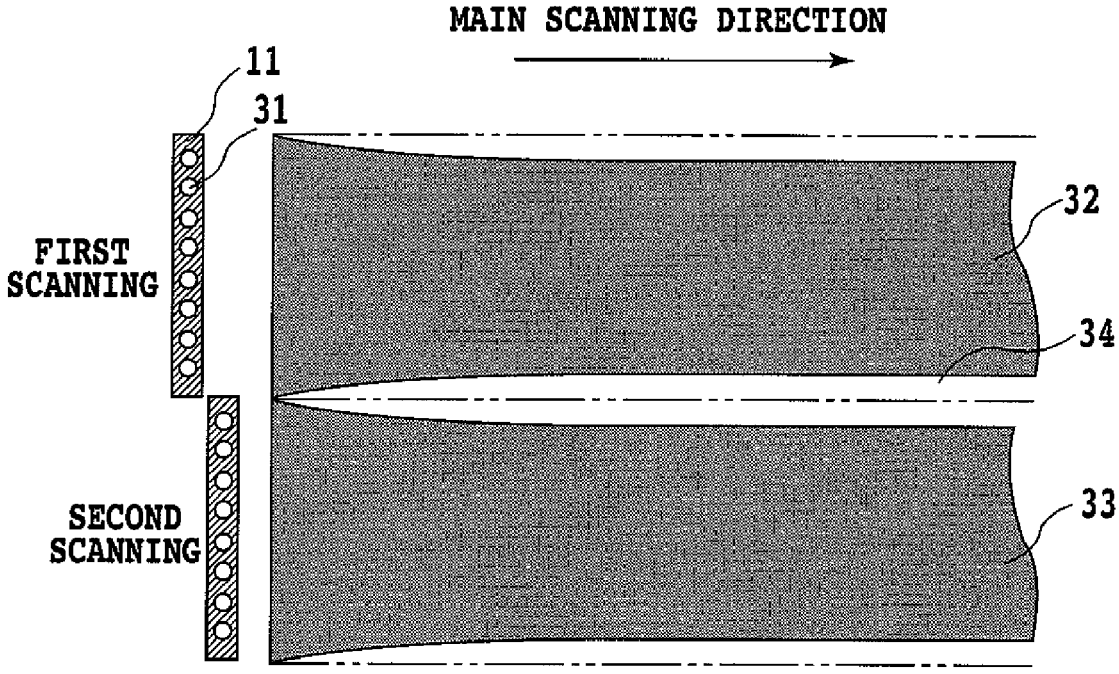
FIG. 3 is a view showing a print state in the case of actually printing an image with the printing head which generates the end-deviation.
Figure 4:
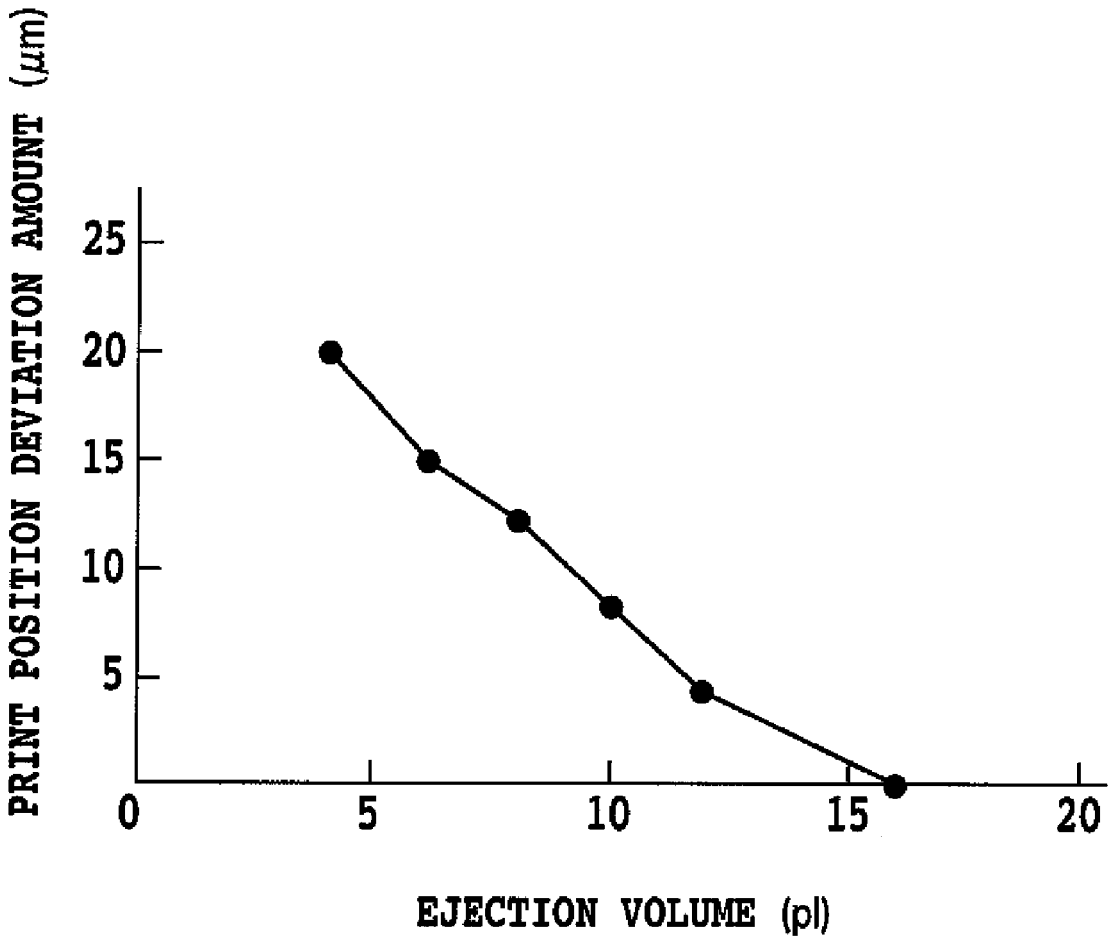
FIG. 4 is a graph showing a relationship between an ejection volume and an end-deviation amount.
Figure 5:
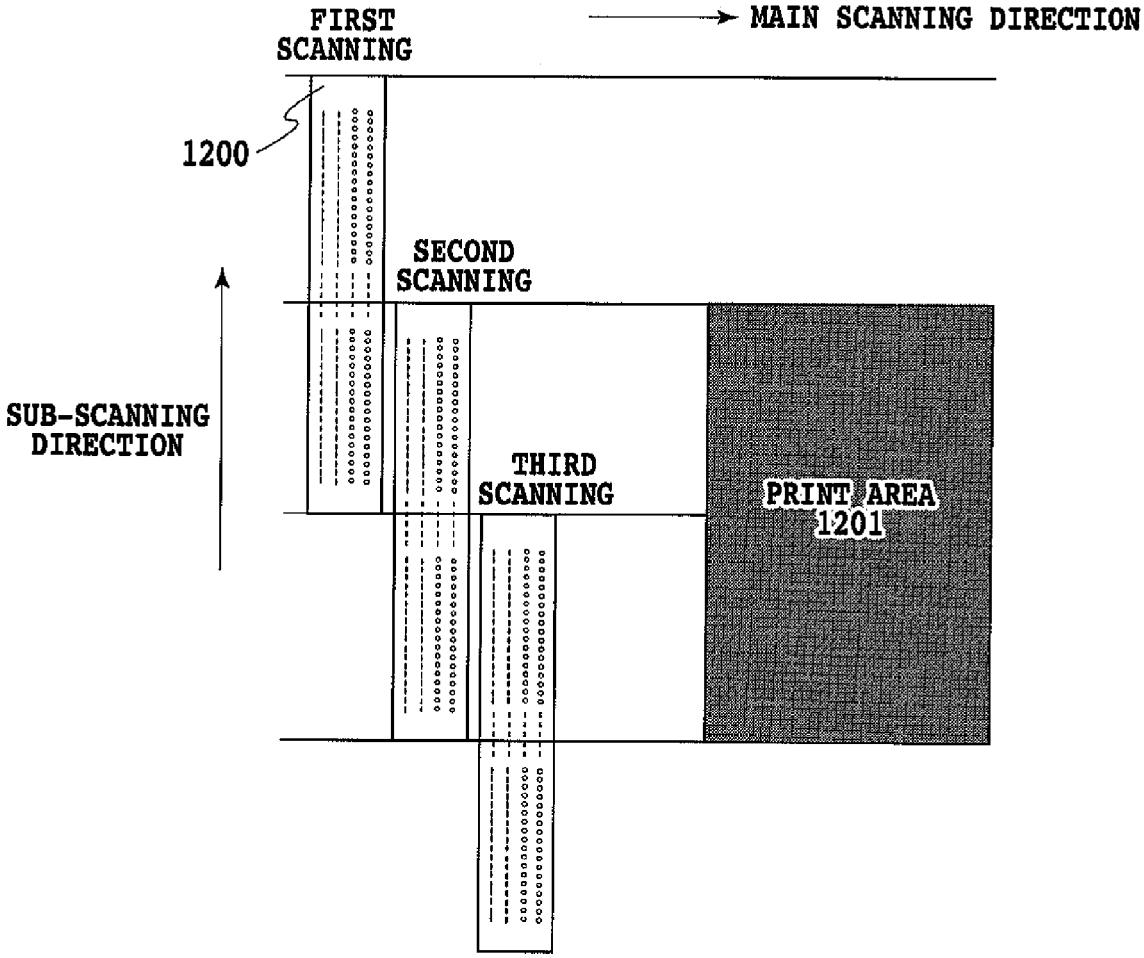
FIG. 5 is an explanatory schematic view of a multi-pass printing method.

In the following second print scanning, printing is performed for the remaining pixels of 50% in backward direction in the image area, where the printing has already been performed for the pixels of approximately 50% by the first print scanning, via the 128 ejection ports positioned at the upper half part of the printing head 1. In addition, in the second print scanning, the lower half part of the printing head 1 performs printing for pixels of approximately 50% of a blank area adjacent to the image area. When the second print scanning ends, the print medium is further conveyed in the sub-scanning direction in FIG. 5 by the length corresponding to half of the print width of the printing head 1. An image is formed in stages by alternately repeating the above reciprocation print main scanning for the pixels of approximately 50% and the sub-scanning of the length corresponding to half of the print width. An approximately 50% printing in each print scanning is performed with the mask pattern prepared in advance.

Figure 8:
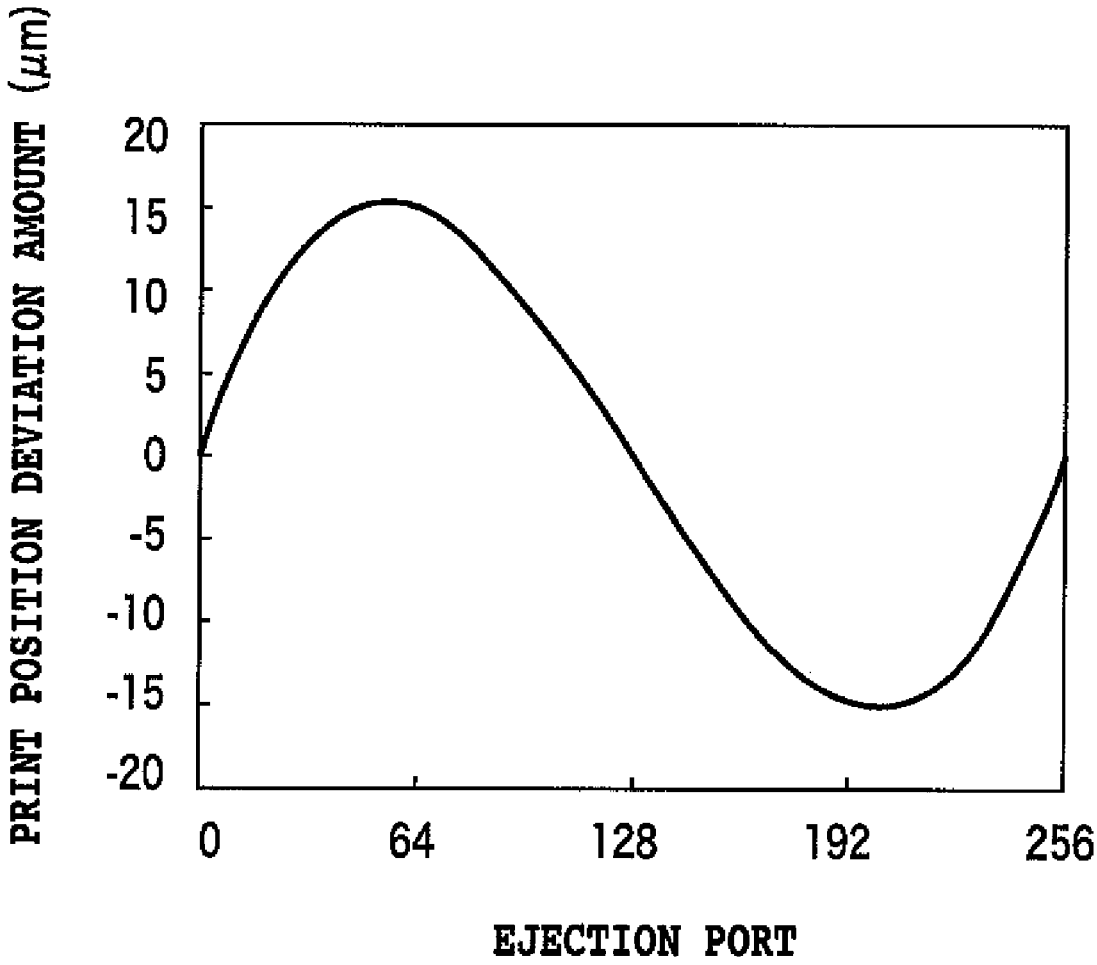
FIG. 8 is a graph showing a relationship between a position of an ejection port and a print position deviation.
Figure 9:
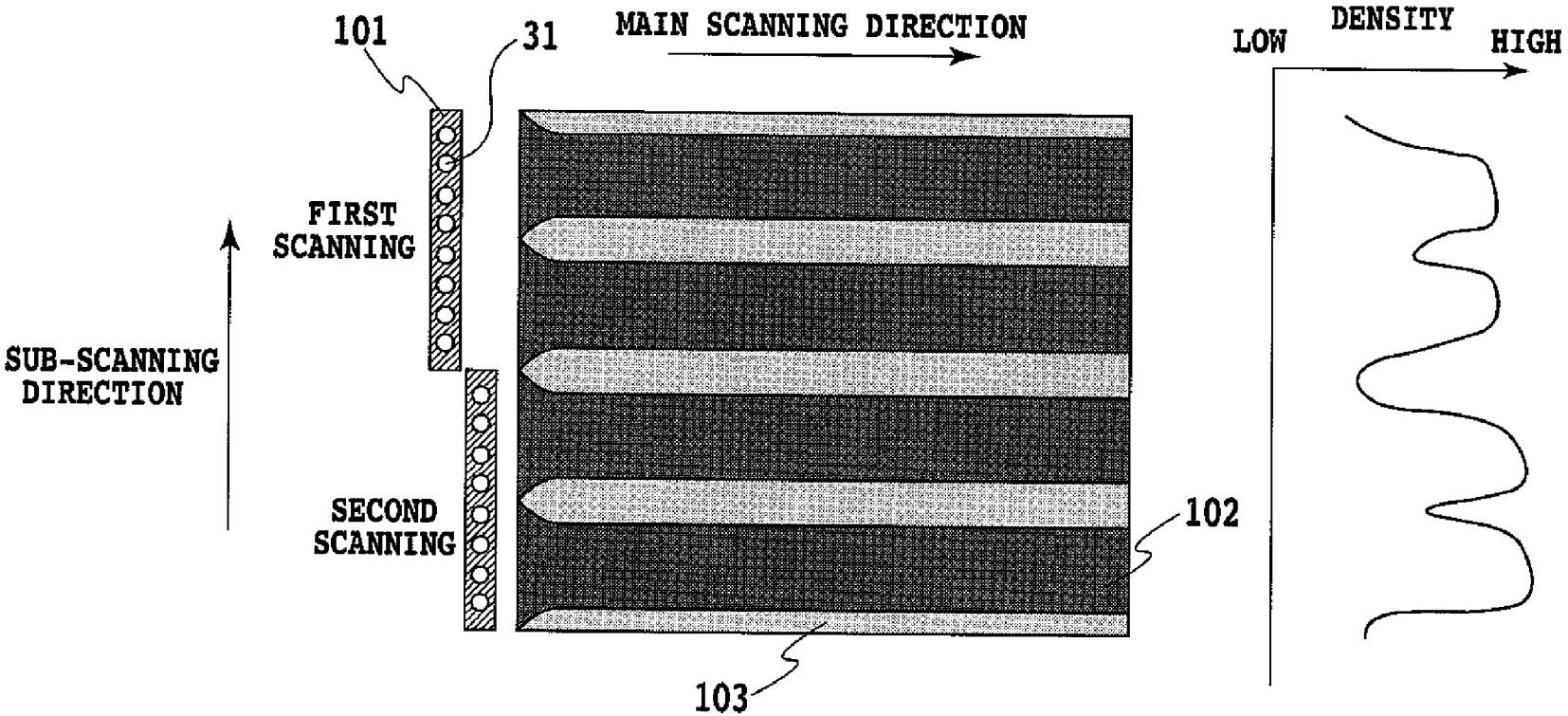
FIG. 9 is a view showing a print state in the case where an image is actually printed by one-pass with use of the printing head in the print state shown in FIG. 8.

As printing conditions in the embodiment, the moving speed of the carriage in the print scanning was 25 inch/sec, and 100% printing was performed by the printing head for the pixels arranged at pitches of 1200 dpi, and the distance between the print medium and ejection port surface was fixed at 1.0 mm. If the two-pass type multi-pass printing is performed with generally used random mask patterns under such conditions, the print position deviation arises having a tendency as shown in FIG. 8. That is, the density unevenness as shown in FIG. 9 is found on a 100% image output. The random mask pattern in the present description is a mask pattern, in which print permission pixels and print non-permission pixels are arranged and prepared at random so that an average print permission rate of all ejection ports becomes 50%. Accordingly, there is no bias shown in FIG. 6, and the print permission pixels are uniformly scattered over the entire area.

Figure 6:
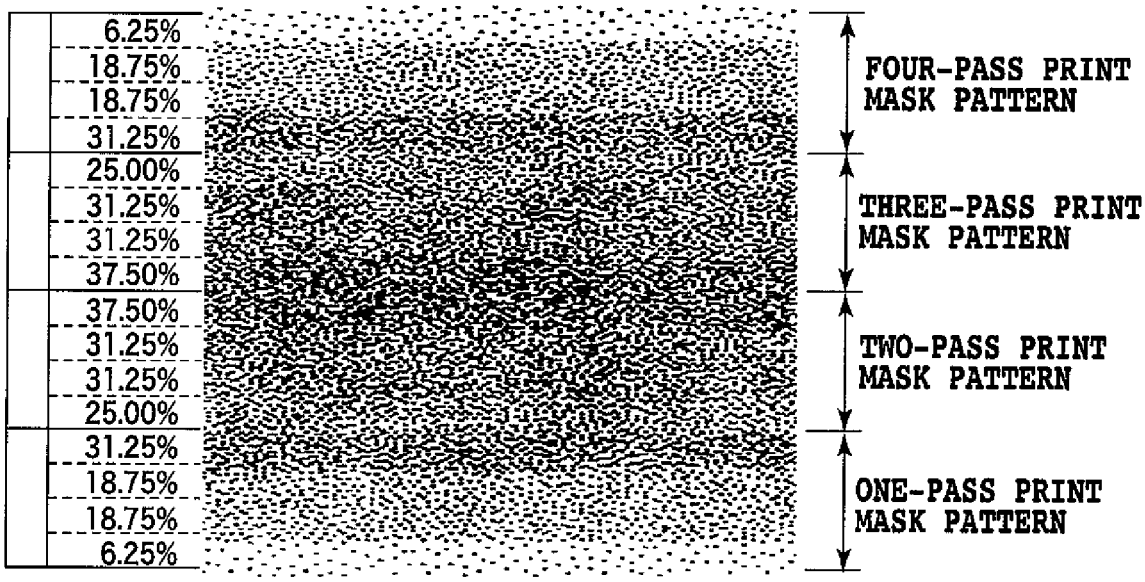
FIG. 6 is a view showing mask patterns which are improved to avoid the end-deviation.

On the other hand, when printing is performed with the mask patterns shown in FIG. 6 disclosed in Japanese Patent Laid-Open No. 2002-096455, the density unevenness is further increased.

Figure 7:
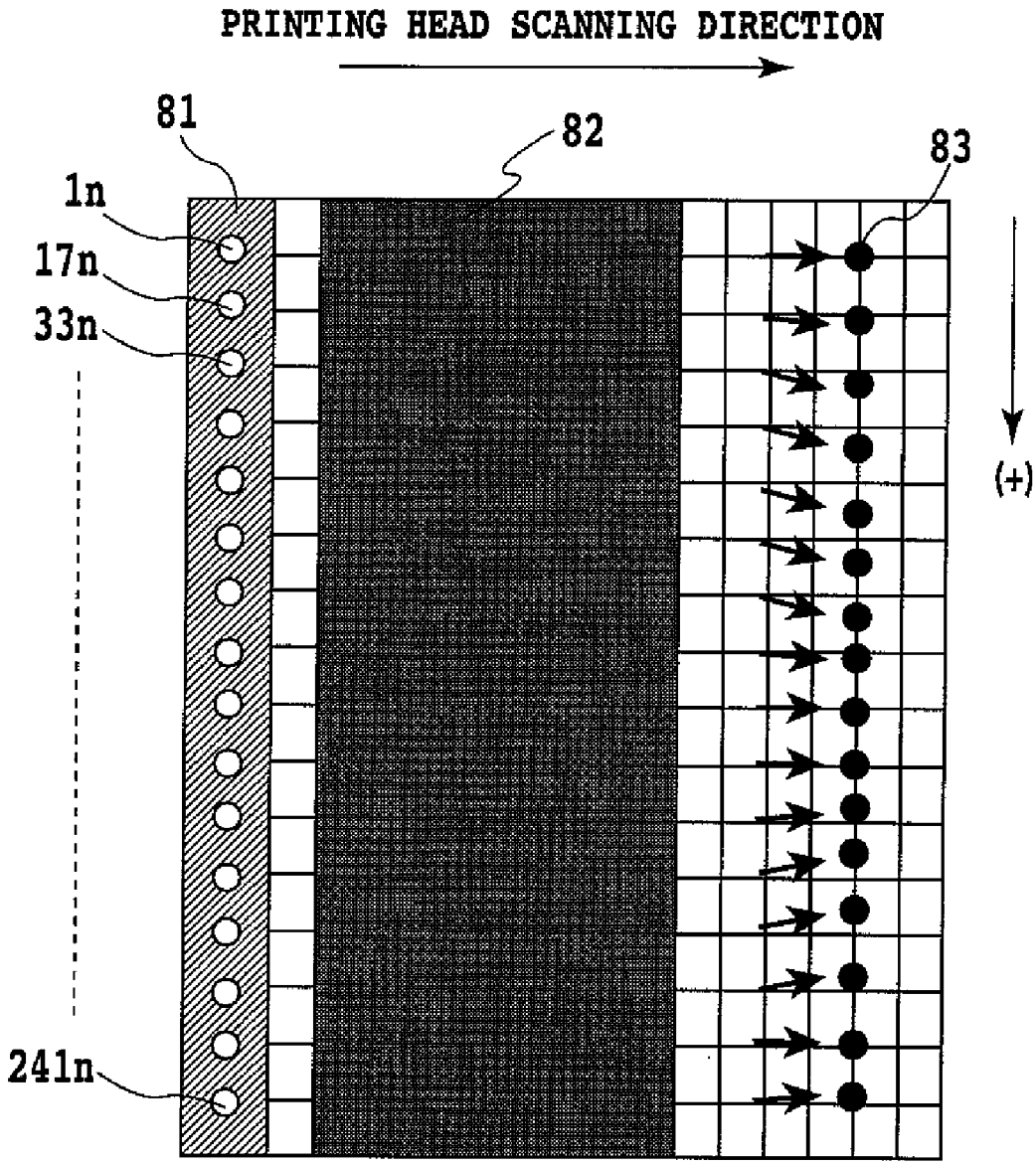
FIG. 7 is a schematic view showing a deflection state in an ejecting direction different from the end-deviation.
Figure 19:
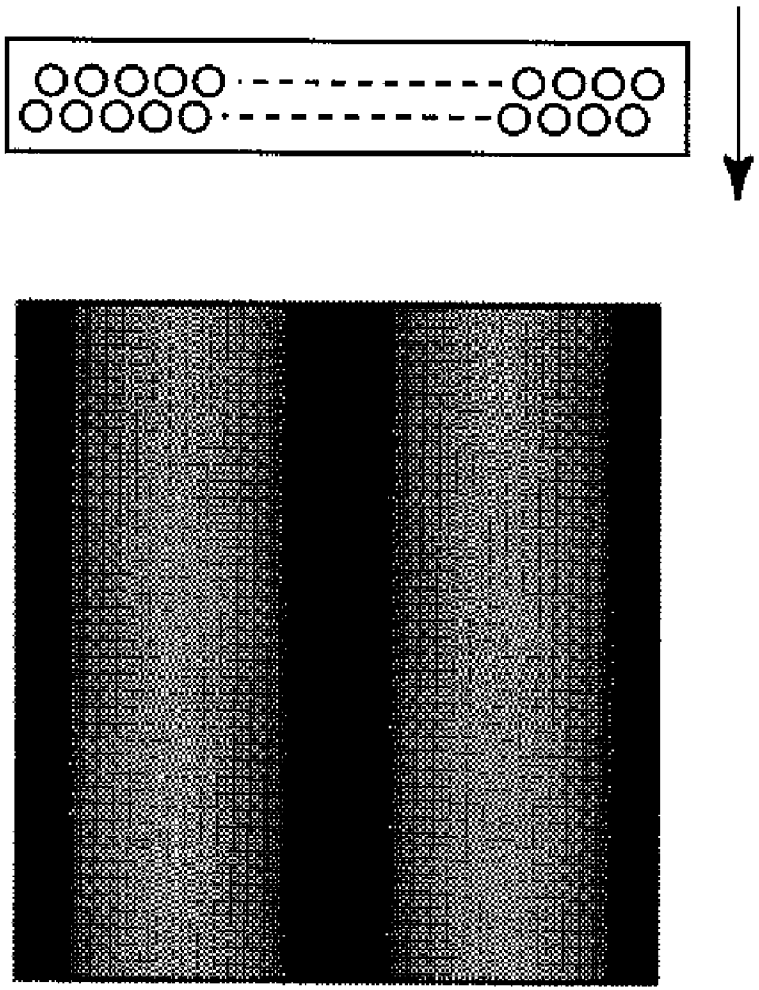
FIG. 19 is a view of a mask pattern employed in the reference example.
Figure 20:
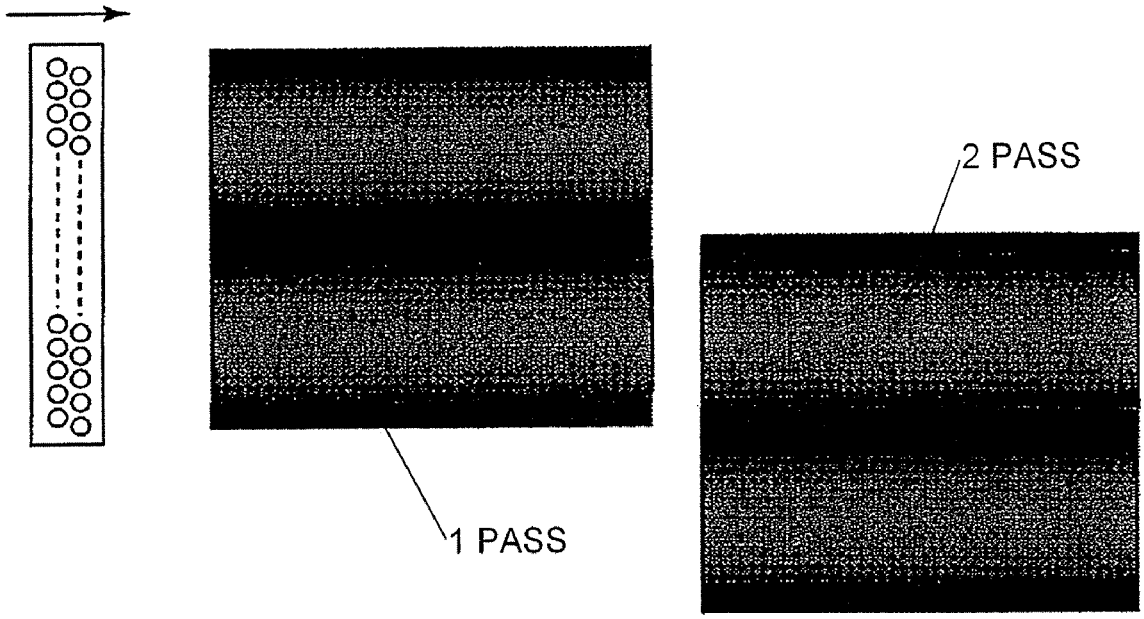
FIG. 20 is a view explaining a problem in the case of performing tow-pass type multi-pass printing with use of the mask pattern of FIG. 19.

As described referring FIGS. 7 and 8, the position of the dot printed via the ejection port positioned at the middle between the outermost ends and the center is most deviated. Accordingly, it is considered that if the frequency of ejecting via the ejection ports positioned at vicinity of the middle is reduced, the adverse effects of the print position deviation would be diminished. Regarding a mask pattern in which the print permission rates of the ejection ports positioned at vicinity of the middle is reduced. FIG. 19 is an example of thus mask pattern, in which the print permission rates of the ejection ports positioned at vicinity of the middle is lowered compared with that of the ejection ports positioned at center and both end. Employing thus mask pattern, the print position deviation generated in one print scanning is reduced.

However, if the two-pass type multi-pass printing is performed with the mask pattern of FIG. 19, the complementary relationship between 1-pass and 2-pass is not be realized, that is defectiveness as a mask pattern. For a mask pattern employed in two-pass type multi-pass printing, it is necessary that 1-pass mask pattern corresponding to the lower half part of the printing head and 2-pass mask pattern corresponding to the upper half part of the printing head have a complementary relationship each other. However, the mask pattern of FIG. 19 does not have this relationship. In order to reduce the adverse effects of the print position deviation in multi-pass printing, a mask pattern having a complementary relationship and being able to reduce the print position deviation is demanded. A mask pattern shown in FIG. 15 meets the requirement, in which the print permission rates of the ejection ports positioned at both ends each having a small deviation amount are set higher than those of the ejection ports positioned at the other parts (for example, center parts).

Figure 15A:
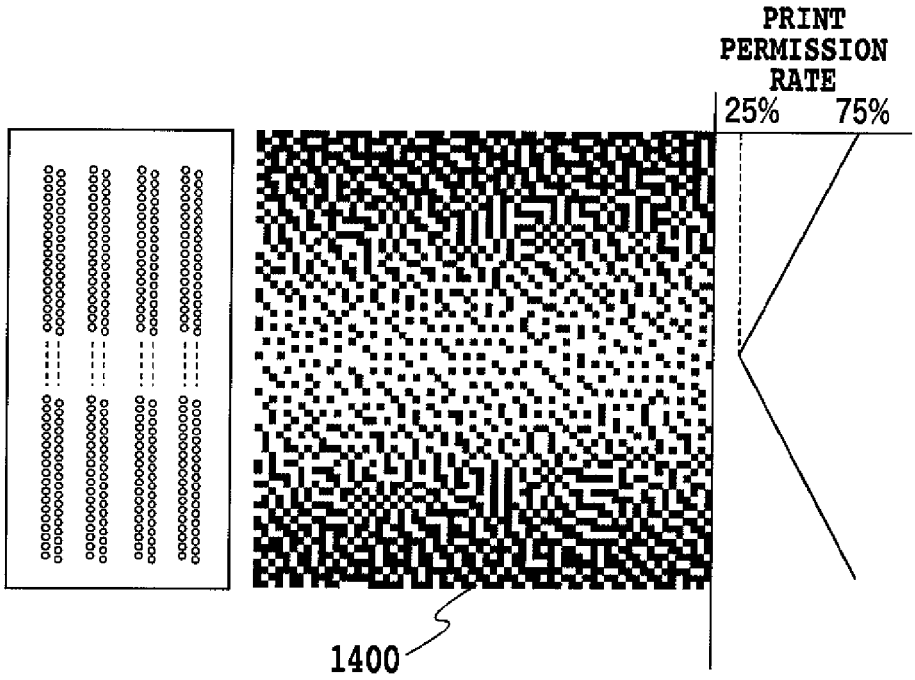
FIGS. 15A and 15B are views of mask patterns employed for the two-pass type multi-pass printing of the first embodiment respectively.
Figure 15B:
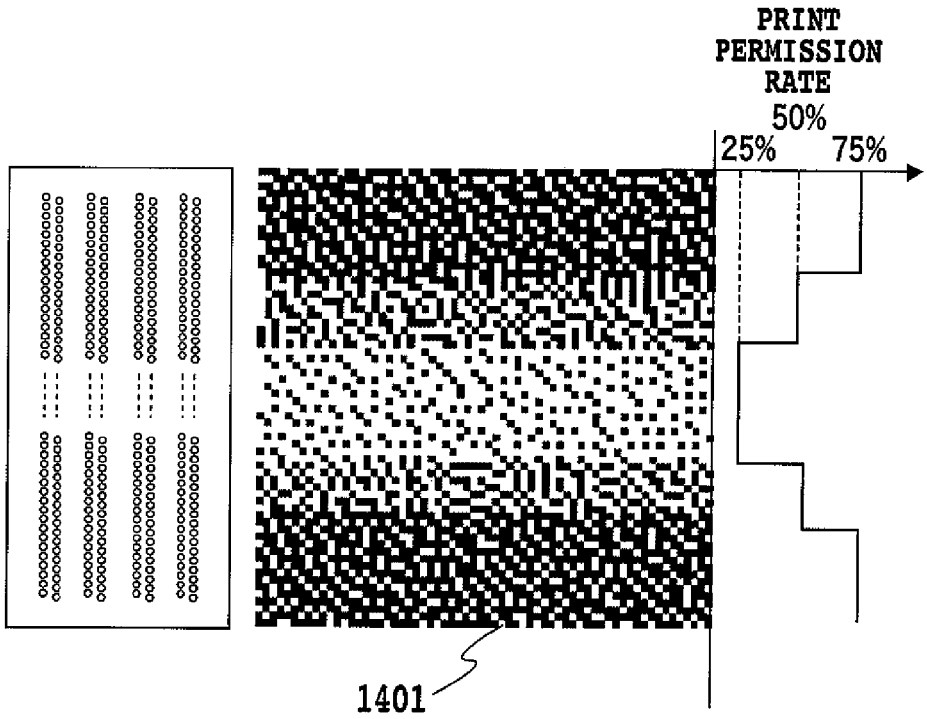

FIGS. 15A and 15B are views of mask patterns employed for the two-pass type multi-pass printing of the embodiment respectively. It is an object of the embodiment to reduce the density unevenness generated in the case where the image is printed with the printing head having the tendency of the print position deviation shown in FIG. 8. Accordingly, a mask pattern is employed in which the print permission rates of the ejection ports positioned at both ends each having a small deviation amount are set higher than those of the ejection ports positioned at the other parts (for example, center parts).

FIG. 15A shows a mask pattern in which the print permission rate is gradually changed in relation to the position of the ejection port, and FIG. 15B shows a mask pattern in which the print permission rate is changed at three stages in relation to the position of the ejection port. In both mask patterns shown in FIGS. 15A and 15B, the print permission rates of both ends are 75%, and the print permission rate of the center is 25%.

When the multi-pass printing is performed with mask patterns 1400 and 1401 in which the print permission rates of the ejection ports at both ends are thus set higher than those of the ejection ports positioned at the other parts, the print position deviation shown in FIG. 8 is reduced even if printing is performed with the printing head for ejecting small droplets of 0.6 pl. Accordingly, an image having no density unevenness and having high definition can be obtained.

Furthermore, although the ejection port arrays 1302 to 1305 for four colors are arranged in the printing head of the embodiment, the mask patterns shown in FIG. 15 are not required to be used for all ejection port arrays. Even if the ejection volume is small, there is a case where the end-deviation becomes more conspicuous than the density unevenness depending on the ink color, or there is a case where both adverse effects become inconspicuous. In such cases, a distribution of the print permission rates of the mask pattern may be changed in accordance with the priority of an image adverse effect included in each color. For example, the mask patterns shown in FIG. 6 may be used in the case where the end-deviation becomes more conspicuous than the density unevenness. In addition, in the case where both end-deviation and density unevenness become inconspicuous the conventional random mask pattern may be used so that the frequency of ejecting of each ejection port is made as equal as possible.

In addition, the print permission rate of ejection ports positioned at the both end and at the center is not limited to the combination of 75% and 25%. The print permission rate of ejection ports positioned at the both end and at the center may be a combination of 90% and 10% or a combination of 60% and 40%, for example. If a mask pattern in which the print permission rates of the ejection ports positioned at both ends are set higher than those of the ejection ports positioned at the other parts (for example, center parts) is provided, the mask pattern may have applicability to this invention.

Second Embodiment

A second embodiment of the present invention will be described hereinafter. The inkjet printer and inkjet printing head as described with reference to FIG. 10 to FIG. 12 are used in the embodiment similarly to the first embodiment. However, the arrangement of each ejection port is different from that of the first embodiment.

Figure 16:
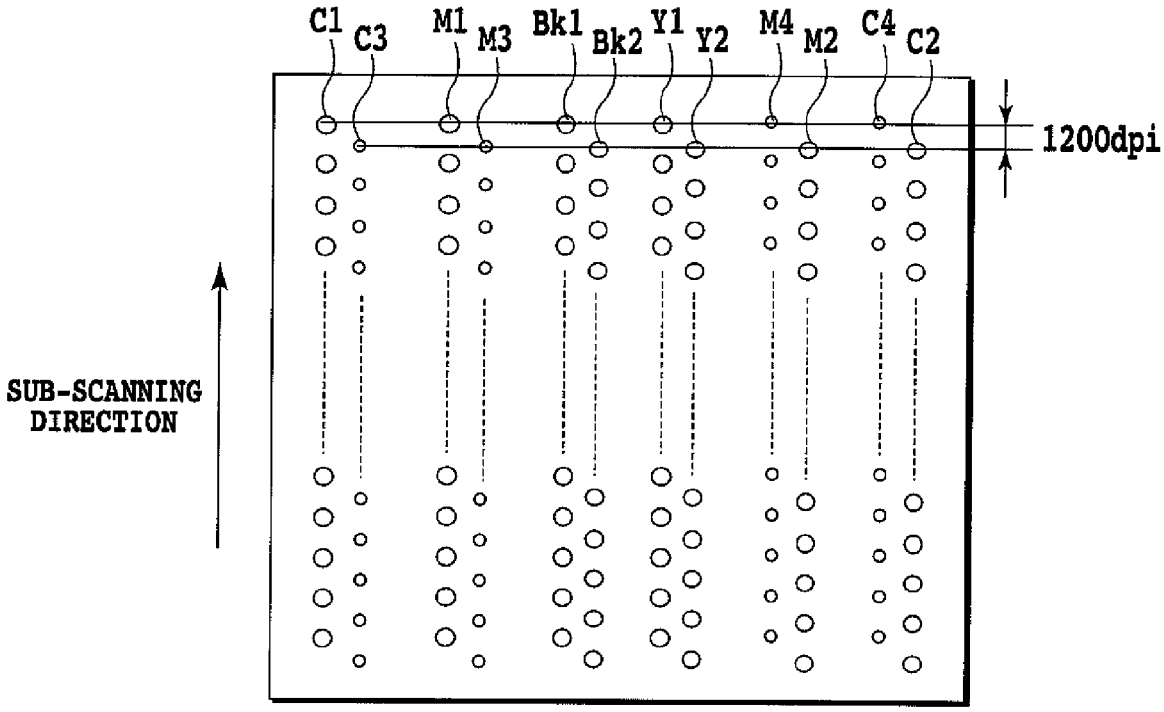
FIG. 16 is a view of a printing head according to a second embodiment of the present invention, which is observed from an ejection port surface side.

FIG. 16 is a view of a printing head 1, which is observed from a ejection port surface side, used in the second embodiment. Twelve large and small ejection port arrays in total are arranged on a substrate of the embodiment, and 128 ejection ports are arranged in each ejection port array at pitches of 600 dpi. Ink droplets of 2.8 pl are ejected from ejection port arrays C1, C2, M1, M2, Y1, Y2, Bk1 and Bk2, and ink droplets of 0.6 pl are ejected from ejection port arrays C3, C4, M3 and M4. In addition, the cyan ink is ejected from the ejection port arrays C1, C2, C3 and C4, the magenta ink is ejected from the ejection port arrays M1, M2, M3 and M4, the yellow ink is ejected from the ejection port arrays Y1, Y2, and the black ink is ejected from the ejection port arrays Bk1, Bk2.

When an image is thus formed in a plurality of stages of ejection volume regarding one color, print data is adjusted for every ejection port array in accordance with an input density signal.

Figure 17:
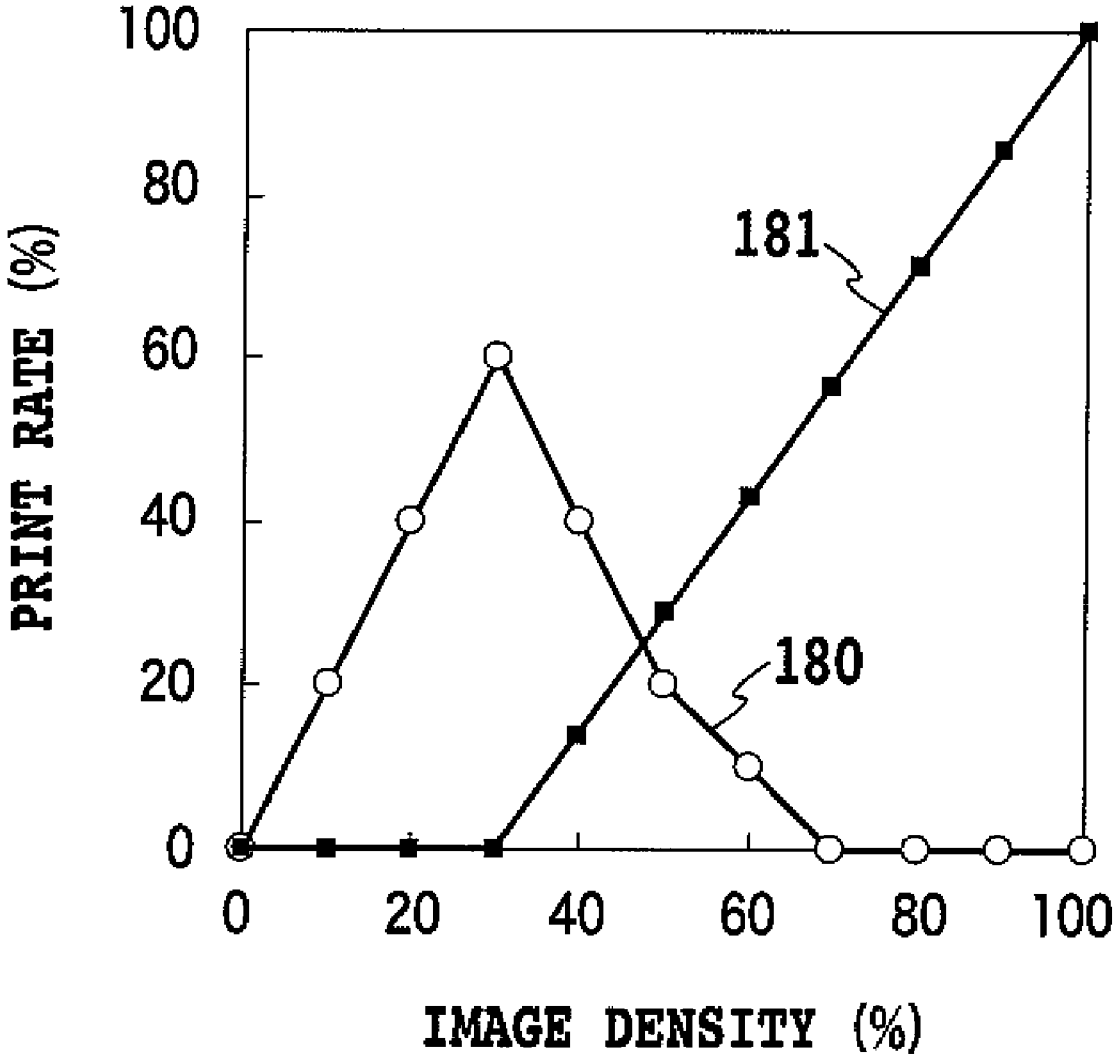
FIG. 17 is a graph showing print permission rate of large and small ejection volumes relative to an input density signal.

FIG. 17 is a graph showing print rates of the ejection port arrays of which the ejection volumes are different from each other relative to an input density signal. Here, the print rate of 100% shows a state where the ink droplets are printed for all pixels one by one. Printings with a large dot (2.6 pl) and small dot (0.6 pl) are possible for all pixels. When an image density is low, only the printing with the small dot is performed. When the image density is raised to a certain degree (30% in this case) the printing with the large dot is started, the rate thereof is gradually increased, and simultaneously the rate of the printing with the small dot is gradually reduced. When the image density becomes maximum (100%), all pixels is printed with the large dot.

Figure 18:
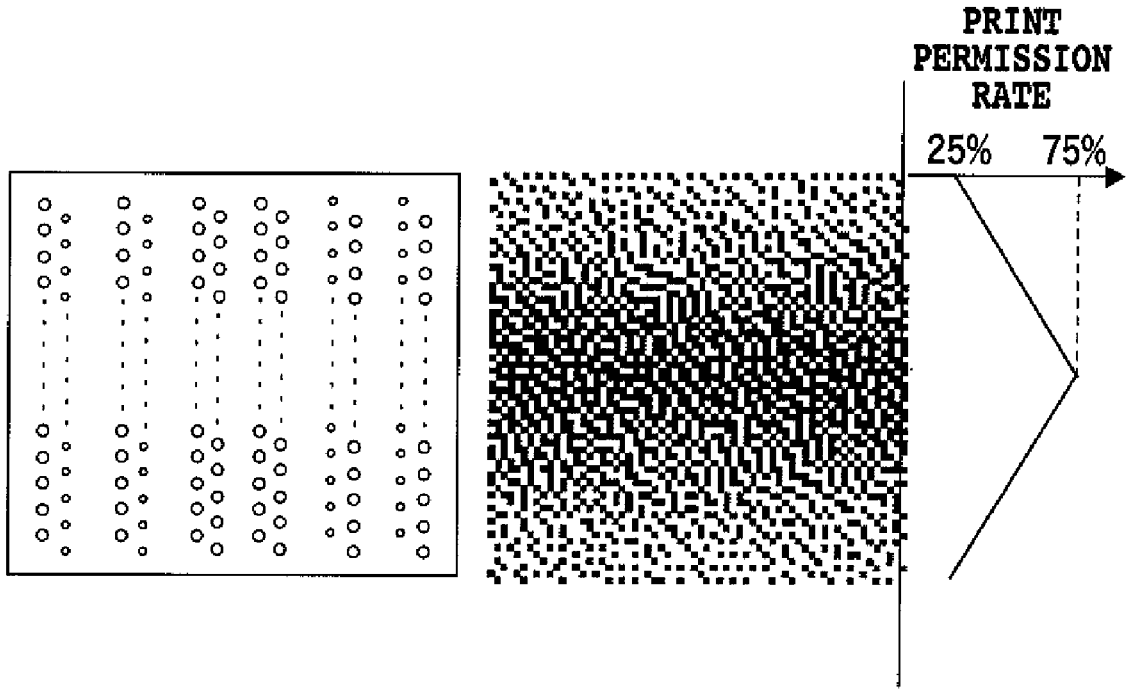
FIG. 18 is a view of a mask pattern employed for an ejection port array having a large ejection volume of the second embodiment.

In the embodiment, the mask pattern 1400 or 1401, in which the print permission rate of the end is higher than that of the center, shown in FIG. 15 is applicable to a ejection port array for which the print position deviation as shown in FIG. 8 is considered to easily arise, that is, the ejection port arrays C3, C4, M3 and M4 each having a small ejection volume. On the other hand, the mask pattern, in which the print permission rate of the end is set lower than that of the center, shown in FIG. 18 is applicable to the ejection port arrays C1, C2, M1, M2, Y1, Y2, Bk1 and Bk2 each of which the end-deviation is considered to easily arise and each of which has a relatively large ejection volume.

According to the embodiment as described above, when an image is printed with a printing head having a plurality of ejection port arrays corresponding to ejection volumes of a plurality of stages, a mask pattern, in which the print permission rates of both ends are set higher than those of the other parts, is made to correspond to the ejection port array having a smaller ejection volume. Thus, the image can be obtained which has no end-deviation and density unevenness and has high definition.

Furthermore, although the two-pass type multi-pass printing is cited in the above embodiments, the present invention is not limited thereto. In this case, when the number of passes is changed, a substantial ejecting frequency of the printing head is also changed. Accordingly, even in the case where the same printing head is used, it can be assumed that the tendency of the print position deviation is changed by changing the number of passes. That is, although the tendency of the print position deviation as shown in FIG. 8 appears and the density unevenness becomes more conspicuous in the two-pass type multi-pass printing, a case, where the end-deviation becomes more conspicuous than the density unevenness, can be assumed in a four-pass type multi-pass printing. In this case, a mask pattern to be employed may be properly changed in accordance with the number of passes.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Laid-Open No. 2006-130790, filed May 9, 2006, which is hereby incorporated by reference herein in its entirety.

What is claimed is:

1. An inkjet printer for printing an image on a print medium by ejecting ink from a printing head having a first ejection port array and a second ejection port array based on print permission rates determined in advance for the respective first and second ejection port arrays while moving the printing head with respect to the print medium, wherein respective print permission rates of respective ejection ports positioned at both ends of the first ejection port array are higher than that of an ejection port positioned at the center of the first ejection port array, and respective print permission rates of respective ejection ports positioned at both ends of the second ejection port array are lower than that of an ejection port positioned at the center of the second ejection port array.

2. An inkjet printing method for printing an image on a print medium by ejecting ink from a printing head having a first ejection port array and a second ejection port array based on print permission rates determined in advance for the respective first and second ejection port arrays while moving the printing head with respect to the print medium, wherein respective print permission rates of respective ejection ports positioned at both ends of the first ejection port array are higher than that of an ejection port positioned at the center of the first ejection port array, and respective print permission rates of respective ejection ports positioned at both ends of the second ejection port array are lower than that of an ejection port positioned at the center of the second ejection port array.

* * * * *